US011053707B2

(12) United States Patent
Lebrija

(10) Patent No.: US 11,053,707 B2
(45) Date of Patent: Jul. 6, 2021

(54) MODULAR PRIVACY AND SOUND BARRIER FENCE SYSTEM

(71) Applicant: Roberto Lebrija, Torrington, WY (US)

(72) Inventor: Roberto Lebrija, Torrington, WY (US)

(73) Assignee: RRM Composites LLC., Denver, CO (US)

( * ) Notice: Subject to any disclaimer, the term of this patent is extended or adjusted under 35 U.S.C. 154(b) by 33 days.

(21) Appl. No.: 15/694,552

(22) Filed: Sep. 1, 2017

(65) Prior Publication Data

US 2019/0071891 A1 Mar. 7, 2019

(51) Int. Cl.

| | |
|---|---|
| ***E04H 17/16*** | (2006.01) |
| ***E04H 17/14*** | (2006.01) |
| ***E04H 17/20*** | (2006.01) |
| *E06B 11/02* | (2006.01) |
| *E04H 17/00* | (2006.01) |

(52) U.S. Cl.

CPC ..... *E04H 17/1413* (2013.01); *E04H 17/1417* (2013.01); *E04H 17/161* (2013.01); *E04H 17/168* (2013.01); *E04H 17/20* (2013.01); *E04H 17/006* (2021.01); *E04H 17/1456* (2021.01); *E06B 11/02* (2013.01)

(58) Field of Classification Search

CPC . E04H 17/14; E04H 17/1417; E04H 17/1421; E04H 17/166; E04H 17/168; E04H 2017/1456

See application file for complete search history.

(56) References Cited

U.S. PATENT DOCUMENTS

| | | | | |
|---|---|---|---|---|
| 4,369,953 A * | 1/1983 | Greiner | E04H 17/143 256/24 |
| 5,702,090 A * | 12/1997 | Edgman | E04H 17/1421 256/19 |
| 2017/0058557 A1* | 3/2017 | Wu | E04H 17/1413 |

FOREIGN PATENT DOCUMENTS

| | | | |
|---|---|---|---|
| EP | 1 156 178 | * 11/2001 | E04H 17/16 |
| FR | 2 741 903 | * 12/1995 | E04H 17/16 |
| FR | 2 958 674 | * 10/2011 | E04H 17/14 |
| FR | 2 991 346 | * 12/2013 | E04H 17/00 |
| GB | 2485412 | * 5/2012 | E04H 17/16 |

OTHER PUBLICATIONS

Translation of FR 2 958 674. worldwide.espacenet.com. Jun. 7, 2019.*

* cited by examiner

*Primary Examiner* — Michael P Ferguson
(74) *Attorney, Agent, or Firm* — Michael L. Greenberg, Esq.; Greenberg & Lieberman, LLC

(57) ABSTRACT

A privacy and sound barrier fence system and apparatus is disclosed. The fence is erected with interlocking horizontal or vertical panels which are held in place by posts at the ends of the boards. The boards are equipped with a tongue and groove system, configured to enable the boards to interlock, forming a solid wall segment. Each segment, referred to as a module, may be connected at a 90 degree angle, to permit a turn in the fence. Adjustable mounting points on the posts allow for the modules to be disposed in a step orientation or at a slope for non-level terrain. The boards ensure that the erected fence remains aesthetically pleasing from both the front and rear of the fence. The fence system does not employ any structural rain reinforcement connecting the posts, and is capable of withstanding hurricane-strength winds.

10 Claims, 13 Drawing Sheets

Sloping Configuration

Variable Height Configuration

MESA GATE

SANTA FE GATE

MODULAR PRIVACY AND SOUND BARRIER FENCE SYSTEM

FIELD OF THE PRESENT INVENTION

The present invention relates to outdoor fences, and more specifically relates to a modular solid-wall privacy fence erected with interlocking boards extending between slotted vertical posts.

BACKGROUND OF THE PRESENT INVENTION

Conventionally, privacy fences are erected with boards disposed in a row vertically, and held in place with one or more posts which are anchored to the ground. These fences provide privacy, and as such, the boards are conventionally disposed close to one another, rather than gapped. Fences such as these are commonly used for lawns for homes, as well as delineating property lines. A lack of spacing between each of the vertical boards ensures that individuals cannot see through the fence from either side.

Unfortunately, many conventional privacy fences are not designed to withstand hurricane-force winds. The few fences able to withstand high winds are often difficult to construct, and are costly to install. Additionally, traditional fences employ at least one reinforcing board extending between the posts on which to mount the pickets or boards. This causes the rear of the fence to appears less aesthetically pleasing than the front of the fence, which is conventionally flat with few asymmetrical imperfections. Conventional fences such as these are often difficult for amateurs to construct properly, and require several tools to erect. If there were a fence that could be erected quickly and easily, that is also aesthetically pleasing from both the front and the rear, the end customer would benefit greatly. Additionally, the majority of the fence systems on the market employ conventional wood boards and posts, which require staining, painting, and other upkeep in order to ensure the boards last for several years. If a fence were to be constructed with durable composite boards constructed of eco-friendly, recyclable materials, painting and staining would not be required, and upkeep of the fence would be minimized.

Thus, there is a need for a new fence system configured to be easily erected with minimal tools that is wind resistant and capable of providing privacy to the end customer. Such a fence is preferably modular, and is configured to provide privacy via horizontal or vertical boards, rather than solely vertical picket boards, and requires minimal effort to construct. Such a fence would also preferably employ durable composite boards that are pre-finished, removing the need to paint or stain the fence over time. Additionally, the boards are preferably configured to interlock with one another, further enhancing the strength and stability of the fence system. Such a system preferably has a design which achieves a sound barrier effect.

SUMMARY OF THE PRESENT INVENTION

The present invention is a modular fence system that employs interlocking boards to erect a stable privacy fence. The interlocking boards may be disposed in the horizontal or vertical position between vertical posts. The present invention is preferably equipped with a unique post design that allows the user to install the product as a one 8 foot section of fencing without the need to purchase a final or a second post, unlike conventional fence systems.

The design of the posts of the present invention also permits the fence module to be assembled with other modules in order to create a line fence, the post design permits the two posts included on the system to bolt each other back to back to create this configuration, it also permits the fence to have a 90 degree direction change by bolting the posts on the side, rather than back to back. The unique design also permits the posts to adjust if the grading of the terrain is not flat. The design permits a unique step adjustment for uneven terrain, wherein the posts, when bolted together, are equipped with at least one adjustment option embodied with a variety of mounting holes. Due to the nature of the interlocking boards, minimal tools and hardware is required to erect the privacy fence of the present invention in a safe, wind-resistant fashion.

Additionally, the design of the present invention achieves a sound barrier effect due to the way in which the slotted posts seal to the hollow boards. Likewise, the hollow boards are made of a composite material, which reduces the noise perceived behind the fencing barrier. As such, the present invention is configured to function as both a sound barrier, as well as a privacy barrier.

BRIEF DESCRIPTION OF THE DRAWINGS

The present invention will be better understood with reference to the appended drawing sheets, wherein.

DETAILED DESCRIPTION OF THE PREFERRED EMBODIMENT

Figure 1:
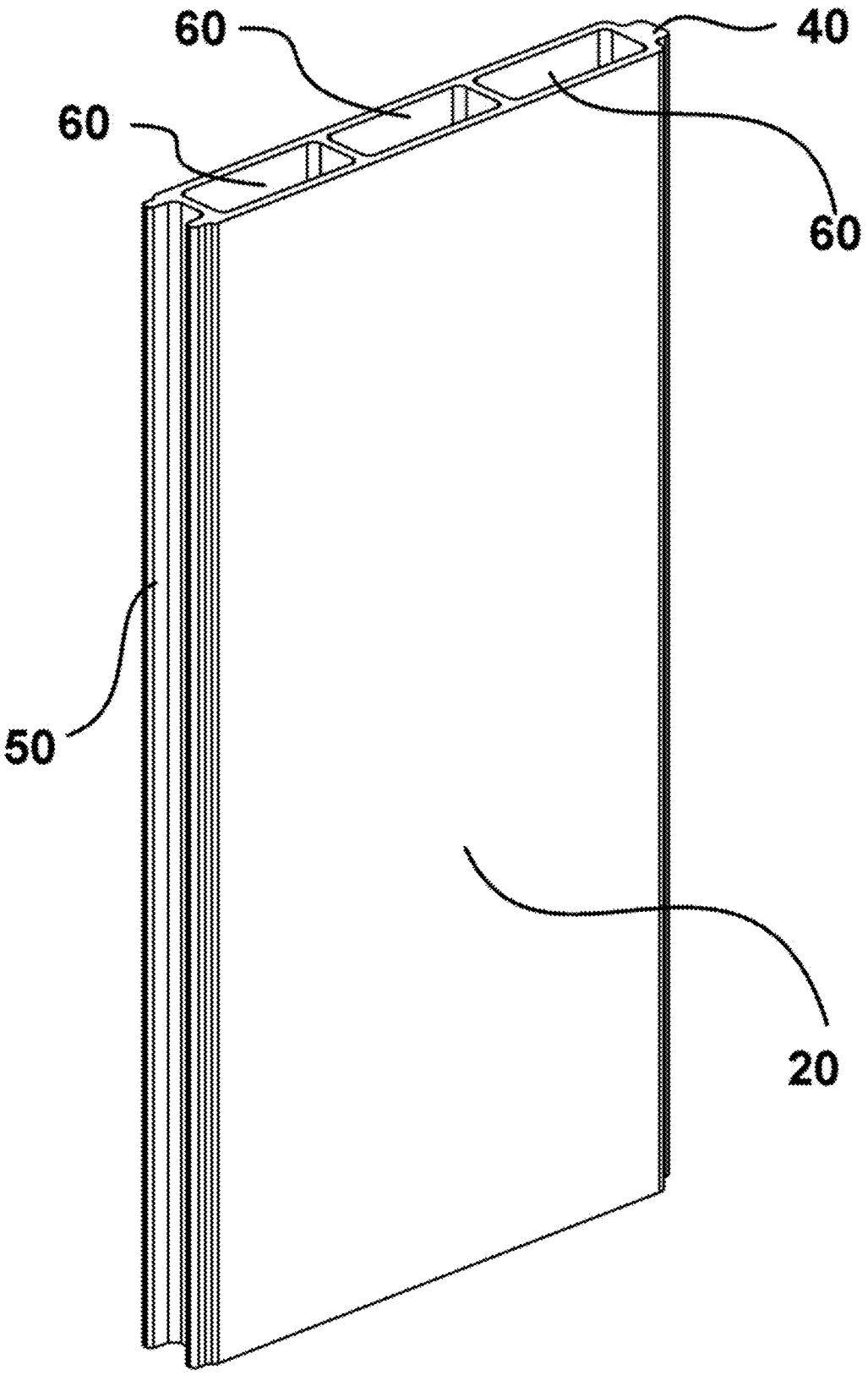
FIG. 1 shows a front view of one of the boards of the present invention, detailing the partially hollow interior of the board.
Figure 2:
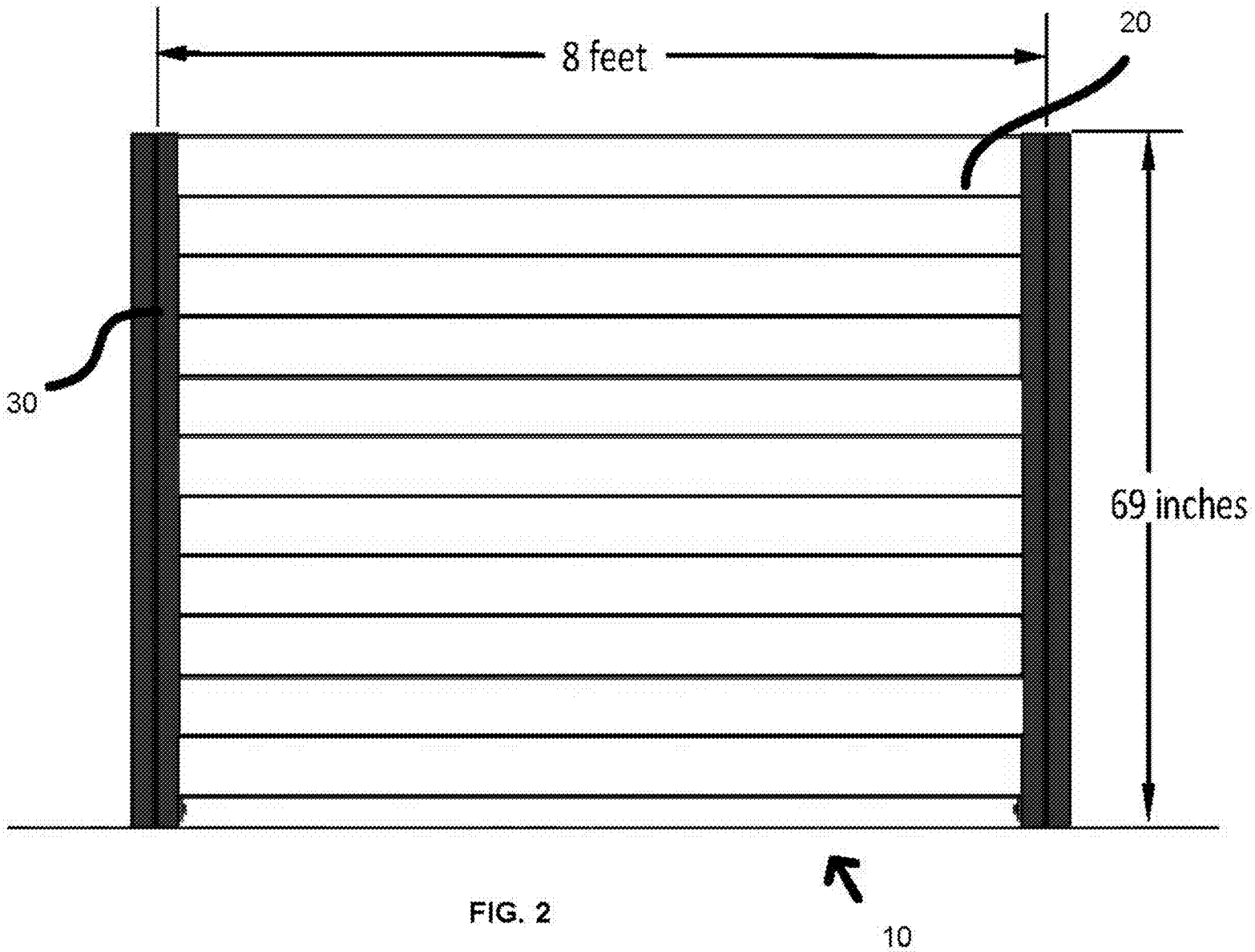
FIG. 2 exhibits a view of the horizontal boards of the present invention arranged in a privacy fence module, detailing the nature by which they interlock together when assembled, and are limited and bound in position via the posts.

The present invention is a modular fence consisting of at least one module (10). Each of the at least one modules (10) includes boards (20) and posts (30). Additionally, each module (10) is preferably 6 feet tall by 8 feet long. The at least one module (10) of the present invention, when properly erected, meets the Miami Dade County wind load requirement, the highest standard in America. As such, the at least one module (10) of the present invention is configured to withstand up to 115 MPH gusts and sustained winds of up to 75 mph.

The modular privacy fence employs posts (30) which exhibit a unique design that enables the user to install the present invention as a singular eight foot section (a module (10)) without any need to purchase a final or a second post as is the case on all existing systems. The posts (30) are equipped with a channel (80) in which the boards (20) are disposed, bound in position via the channels (80). The channels (80), one disposed in each post (30), act as a guide, providing for the boards (20) to slide down the channels (80), aided by gravity, into position, and interlocked with adjacent boards (20). The channels (80) of the present invention are preferably 'U-shaped.'

Figure 3:
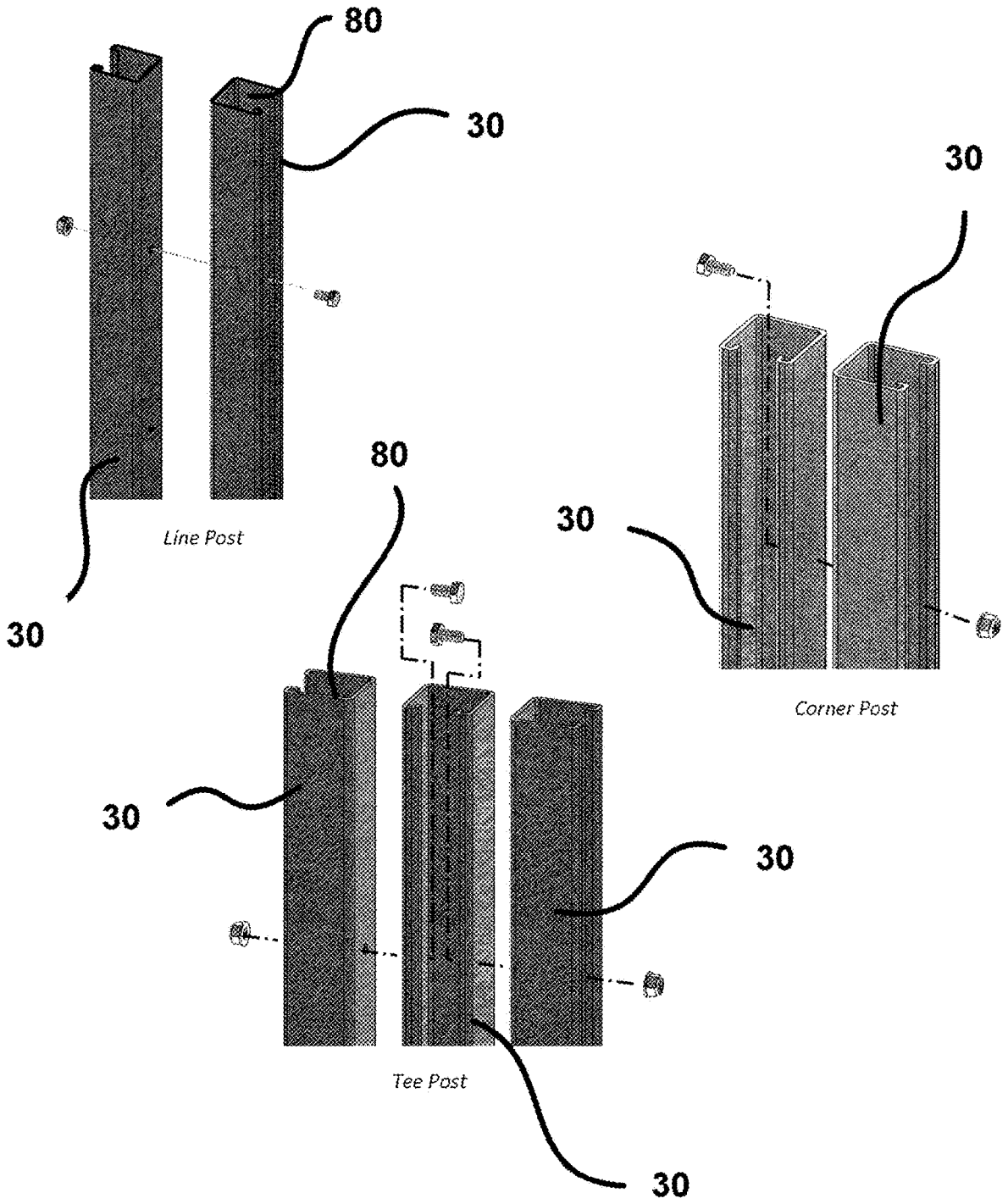
FIG. 3 displays a view of the three post configurations configured to enable a line fence, 90 degree turn in a fence, and a T-shaped arrangement.
Figure 4:
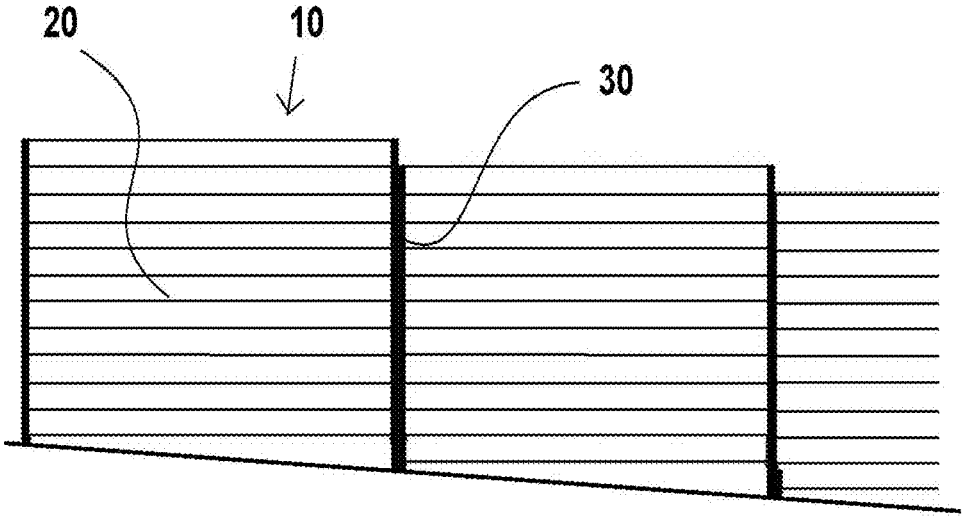
FIG. 4 shows embodiments of the present invention disposed on an incline, as well as in a step configuration.
Figure 4:
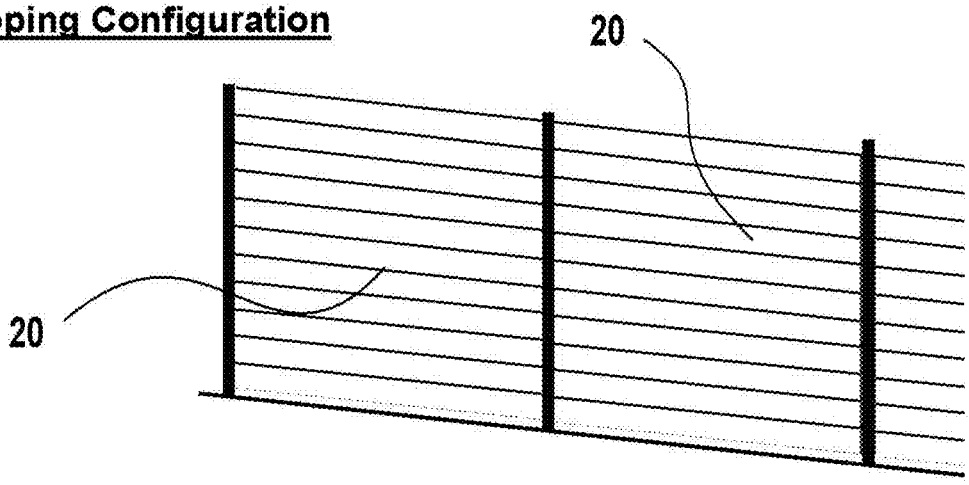
Figure 4:
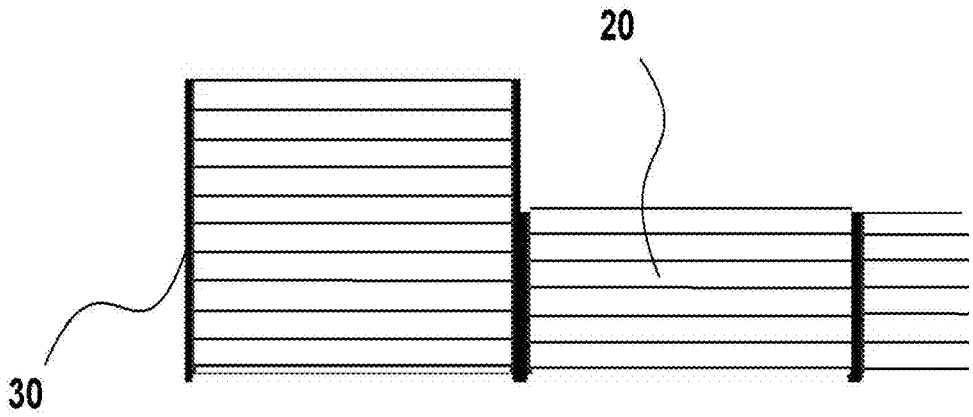

The posts (30) also permit the at least one module (10) to be assembled with other modules (10) in order to create a line fence. The post design enables the posts (30) to be oriented in one of two ways, two posts oriented rear-to-rear, or two posts oriented rear-to-side. The rear-to-side configuration, as shown in FIG. 3, facilitates a 90 degree turn in the line of the privacy fence. The unique design also permits the posts to adjust if the grading of the terrain is not level, as shown in FIG. 4. The design permits a unique step adjustment where the posts when bolted against each other have an adjustment option. The difference with other systems is that with the design of the present invention, the fence boards will always be installed all the way to the top of the post, making the product perform and look good. Additionally, the posts (30) of the present invention are preferably powder-coated steel, helping to ensure a highly durable privacy fence that is aesthetically pleasing.

The boards (20) of the present invention are preferably conventional composite boards constructed of recycled materials. The boards (20) are preferably equipped with at least one cavity (60), making the boards (20) partially hollow. The design of the boards (20) permits a light design, ensuring that the boards (20) remain structurally sound to hold the pressure of the wind without issue. Conversely, if the boards were to be solid, the boards (20) would have a greater weight, and would not be as structurally sound. The design of the posts (30) and the boards (20) ensures that a conventional reinforcement board is not needed. Additionally, the boards (20) of the fence module (10) are preferably equipped with a tongue (40) and a groove (50), which are configured to interlock when stacked in all embodiments of the present invention. In this manner, the boards fit securely together, and require no fasteners. It is envisioned that the boards (20) of the present invention are preferably available in a variety of colors and patterns, including, but not limited to, timber brown, rosewood, raven, and charcoal gray.

A bottom rail (45) is disposed along the ground, at the base of the present invention, and extends between posts (30) of each segment (10), aiding the strength of the fencing. The bottom rail (45) also provides for easy adjustment of the overall height of the boards, and helps to facilitate leveling of the top of the fence to the top of the posts (30). In some embodiments of the present invention, a top rail (55) is configured to sit atop the boards (20) when disposed between the post, the finalize installation, and ensure the boards (20) remain in position.

When constructed, the design permits a self-aligning mechanism that gives two primary benefits: the first benefit is that the boards (20), once installed on the posts (30) and interlocked together via the tongues (40) and grooves (50), become a one structural, unit causing the product to be strong and flexible. The second is the aesthetics; the tongue and groove system secures the position of the fence boards horizontally, ensuring that the fence remains pleasing to the eye from both the front and rear of the fence. The posts (30) remove the need for a traditional reinforcement board(s) to provide stability to the fence. Namely, the nature of the present invention ensures that both the rear and the front of the at least one module (10) appear identical.

The present invention provides the only system on the market that includes a full eight foot privacy fence panel, the at least one module (10), in one box. All components of the at least one module (10) are ideally bundled together for installation, which preferably include 11 boards (20), two modular posts (30), and all necessary hardware, such as screws. Additional modules can be purchased in bundles or, if needed, replacement boards (20) may be purchased separately. The posts (30) are preferably made of low-carbon strip steel, and may be colored and/or powder coated to the taste of the consumer.

The at least one module (10) of the present invention may be erected to facilitate the placement of the fence on an incline. As seen in FIG. 4, the posts are equipped with a variety of mounting holes (70), which act as a placement point to link a post (30) from a first module (10) to a second post (30) of a second module (10).

Additionally, at least one end cap (90) is preferably included with each of the at least one module (10) of the present invention. The at least one end cap (90) is configured to be affixed to the top of the posts (30) to provide a pleasing aesthetic appearance to the present invention when construction is completed. The end cap (90) additionally functions to ensure that the boards (20) remain in the preferred position, and may not be easily removed.

Figure 5:
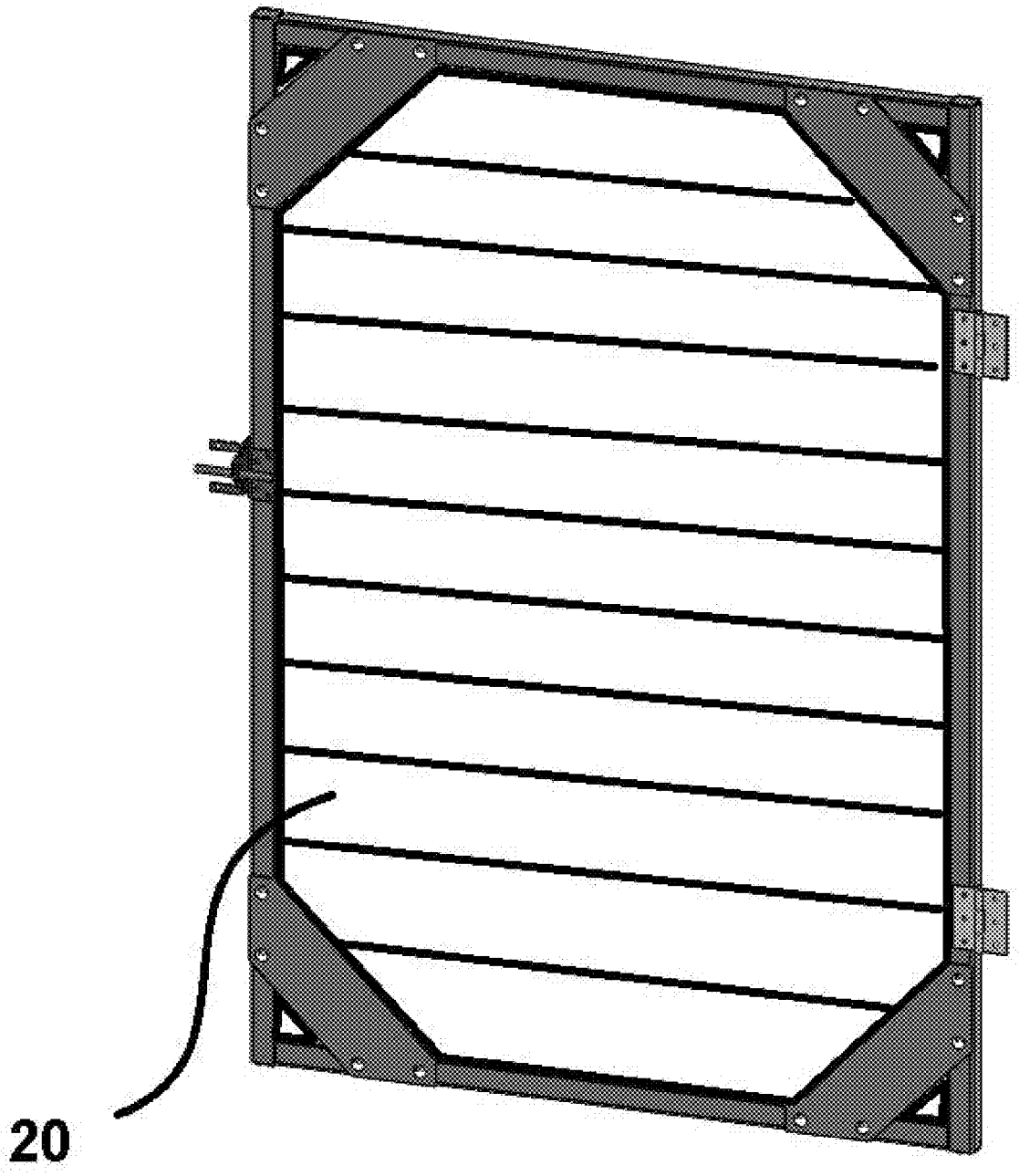
FIG. 5 details a gate which may be erected to accompany the privacy fence of the present invention, fashioned of the same horizontal boards as the at least one module of the present invention.
Figure 6:
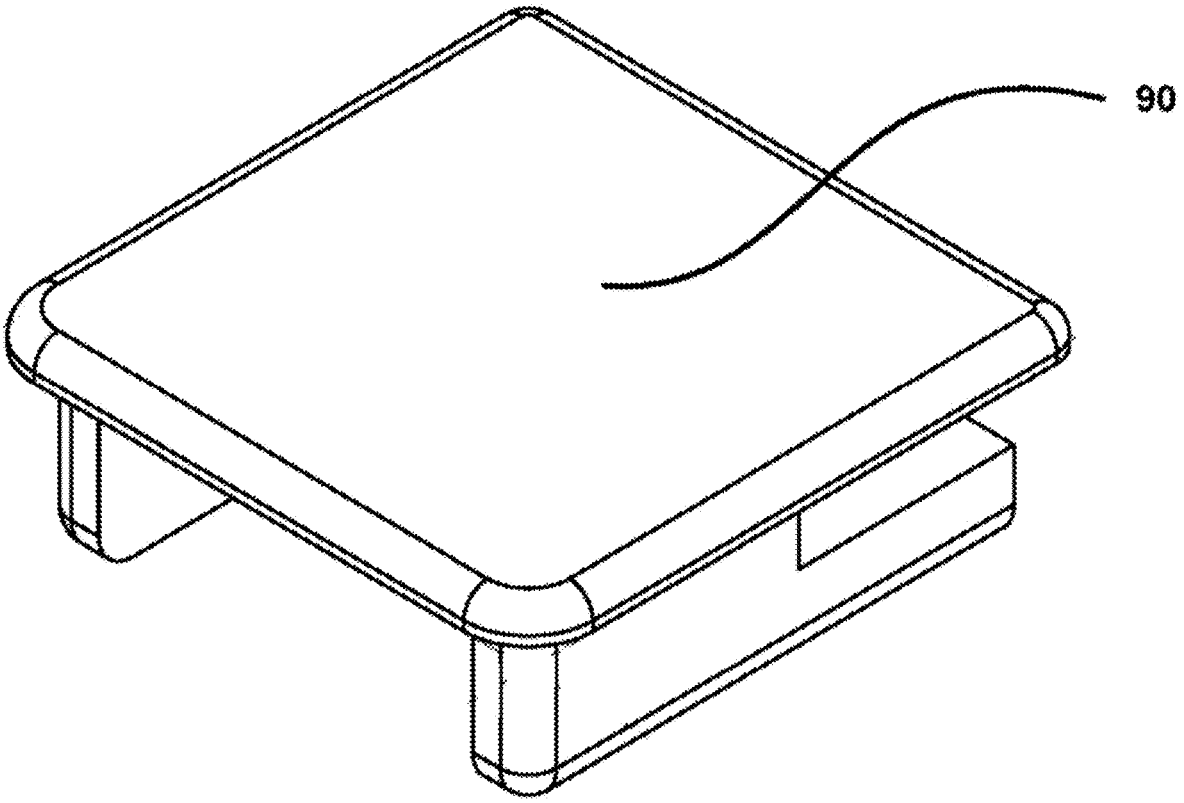
FIG. 6 exhibits the end cap of the present invention to be disposed atop each post.
Figures 9A, 9B:
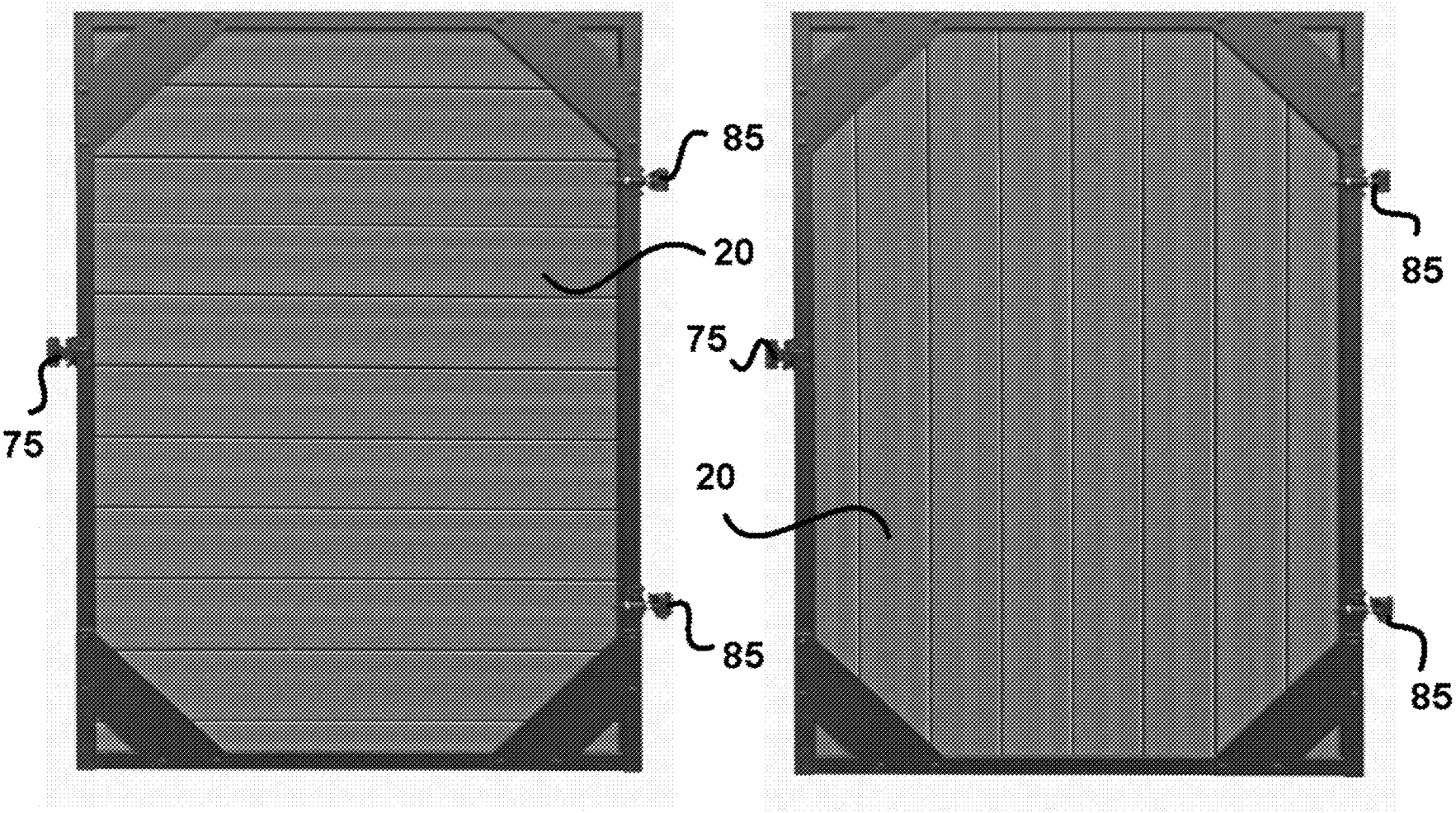
FIG. 9A shows a view of the Santa Fe embodiment of the present invention, depicting the gate.
FIG. 9B shows a view of the Mesa embodiment of the present invention, depicting the gate.

Additionally, it should be understood that the boards (20) may be employed to erect a gate, as disclosed in FIG. 5, FIG. 9A, and FIG. 9B. Such a gate preferably employs similar boarders as posts (30) that are also equipped with a channel (80) to guide, hold, and maintain the boards (20) in position on the gate. Hinges (85), as well as a latch (75) are preferably included within the purchase of the pre-constructed gate, in either the Santa Fe embodiment or the mesa embodiment of the present invention.

Figure 7:
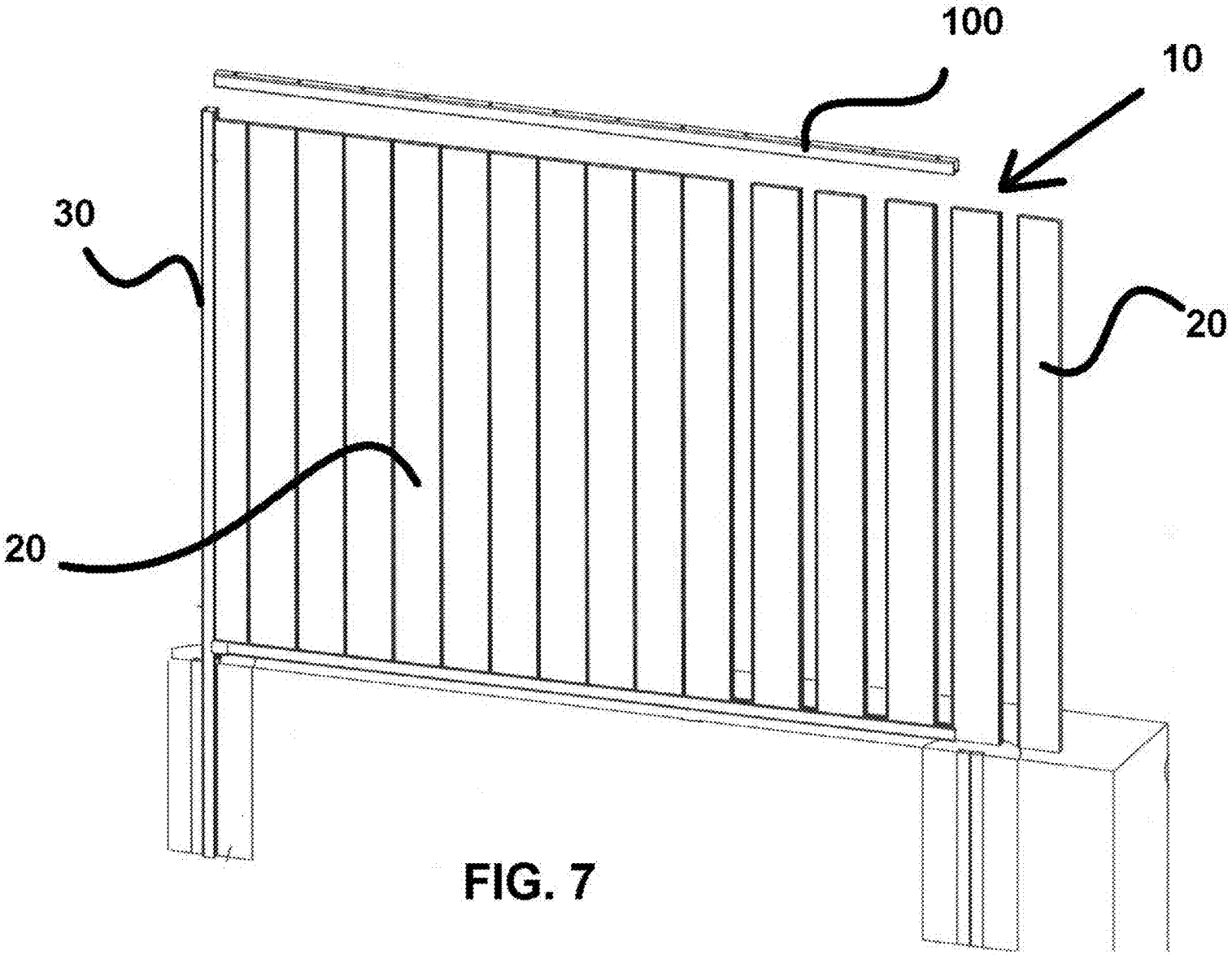
FIG. 7 exhibits a view of the vertical embodiment of the present invention, detailing the vertical boards of the present invention arranged in a privacy fence module.
Figure 8:
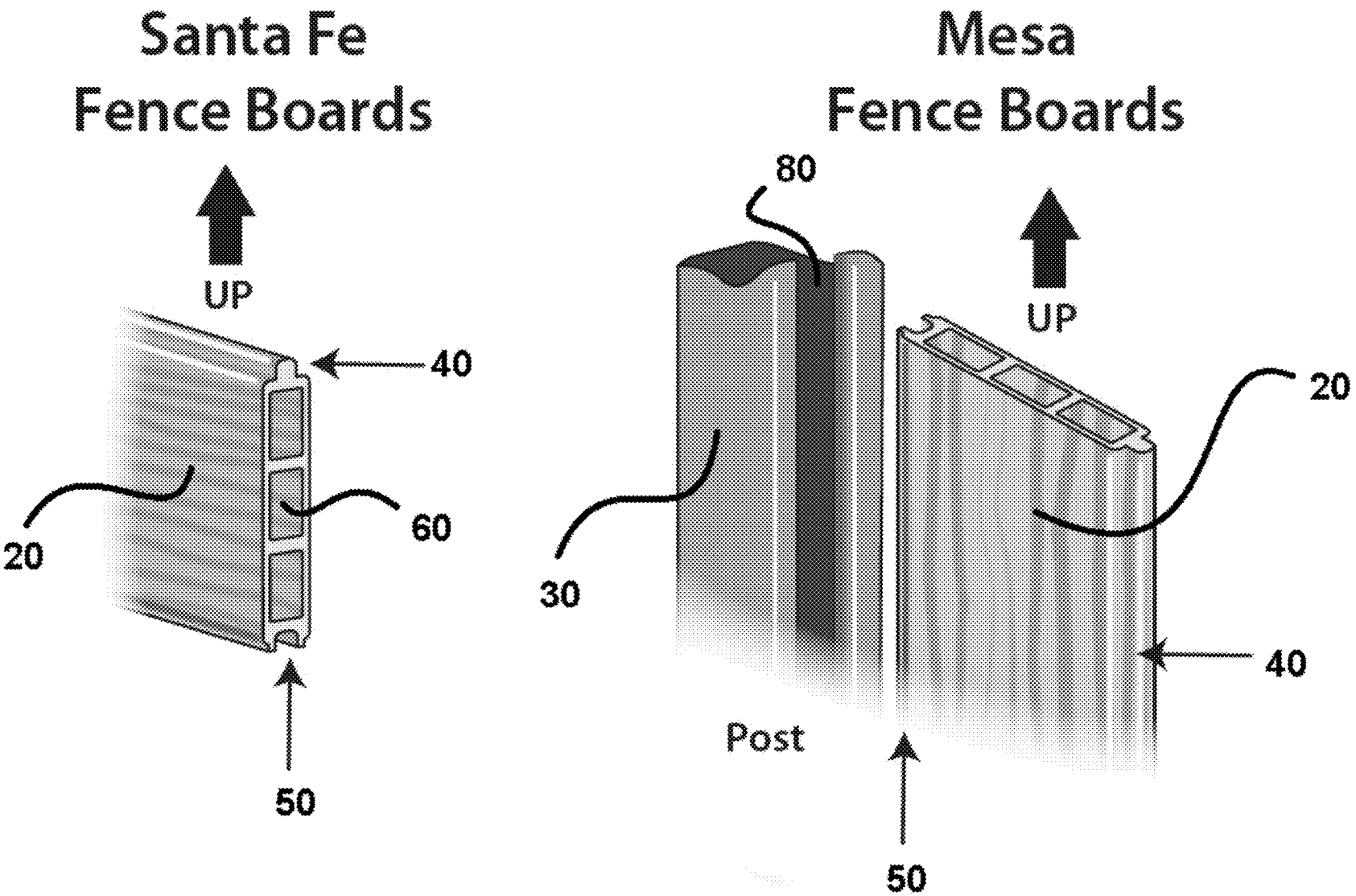
FIG. 8 shows a close-up view of the fence boards of the present invention, including the tongue and groove of each board, as well as the designed orientation for placement within the posts.

Vertical embodiments (referenced as the Mesa fence embodiment) of the present invention, such as those depicted in FIG. 7, preferably employ the same interlocking boards (20) of the horizontal embodiments of the present invention. The boards are securely held together due in part to the tongue and grooves of the boards (20), as well as from the posts (30), which are similarly equipped with a channel (80) to ensure the boards (20) remain in position even under stresses of high winds. In the vertical embodiment depicted in FIG. 7, the present invention is equipped with a top post (100), which is configured to be secured atop the entirety of the vertical boards (20), providing additional strength and coherence to each module (10). The top post (100) is preferably equipped with a groove at a bottom of the top post (100), which is configured to accept the top portion of the vertical boards (20) of the module (10).

Figure 13A:
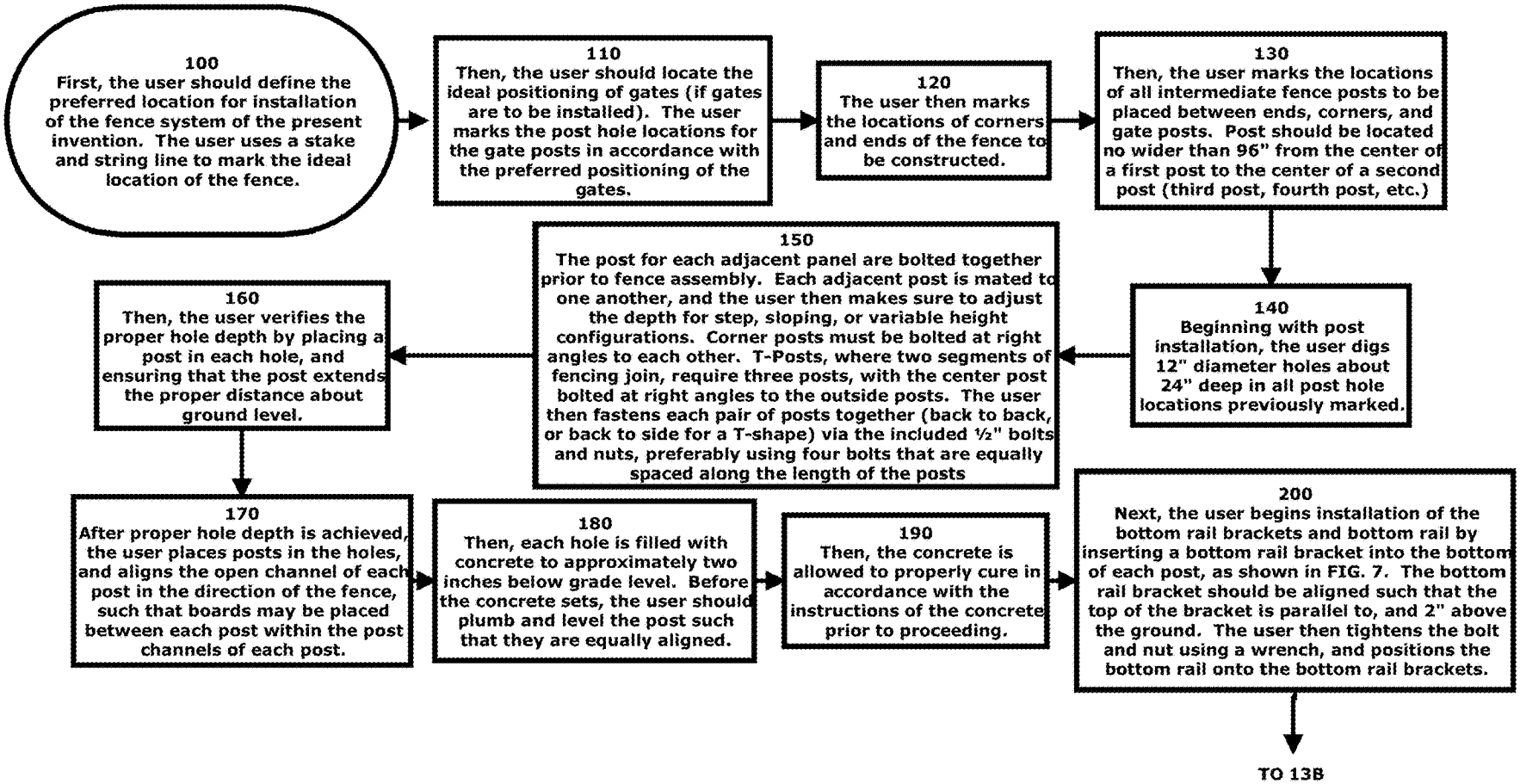
FIG. 13A shows a first portion of a flow chart of the process of installation of the present invention.
Figure 13B:
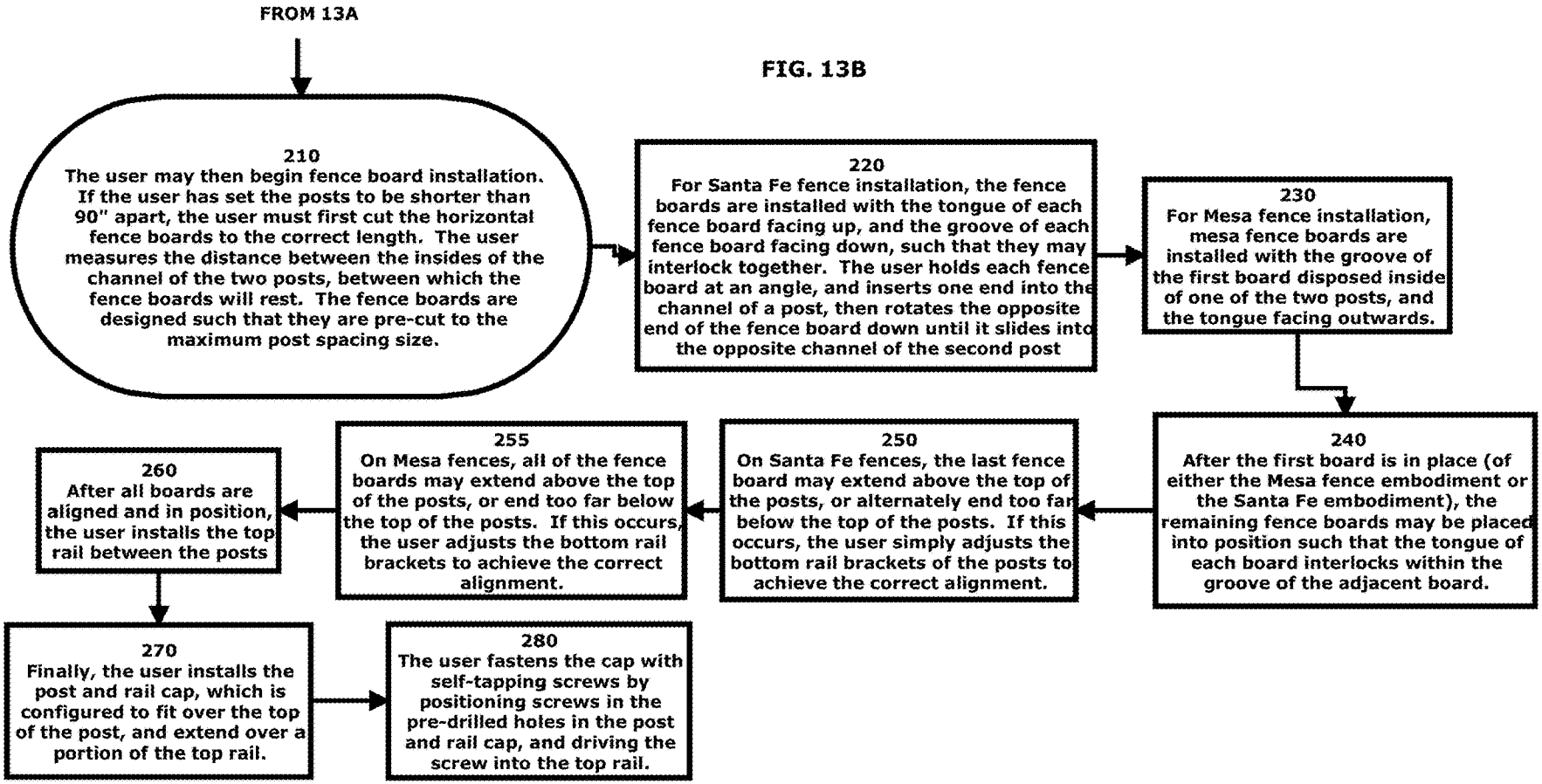
FIG. 13B depicts a second portion of the flow chart of the process of installation of the present invention.

Installation of the present invention, as depicted in FIG. 13A and FIG. 13B, is preferably enacted as follows:

1. Before beginning, the user is encouraged to confirm the location of underground utilities before digging via a utility company location service. Additionally, it is recommended to locate official property lines, to ensure that the present invention is installed in the correct location. Similarly, the user should obtain any and all necessary permits as required by local building codes, zoning laws, and regulations.

2. The user acquires the requisite tools for installation, including stakes, string line, a tape measure, spray paint (if desired), a level, a miter saw, a wheel barrow, a post hole digger, a shovel, a wrench/socket, and a drill equipped with a 3/16" nut driver bit.

3. First, the user should define the preferred location for installation of the fence system of the present invention. The user uses a stake and string line to mark the ideal location of the fence. (100) It is recommended that the user locate the fence three to five inches inside of the property line to prevent encroachment onto a neighbor's property.

4. Then, the user should locate the ideal positioning of gates (if gates are to be installed). The user marks the post hole locations for the gate posts in accordance with the preferred positioning of the gates. (110)

5. The user then marks the locations of corners and ends of the fence to be constructed. (120)

6. Then, the user marks the locations of all intermediate fence posts to be placed between ends, corners, and gate posts. Post should be located no wider than 96" from the center of a first post to the center of a second post (third post, fourth post, etc.) (130)

7. It should be noted that, when laying out the initial post locations, the user may end up with a non-uniform section at the end of the fencing structure. To prevent this, and to create a uniform fence, the user should space all panel sections at equal lengths.

8. Beginning with post installation, the user digs 12" diameter holes about 24" deep in all post hole locations previously marked. (140).

9. Each eight-foot panel of both embodiments of the fence system of the present invention requires a post at each end. The post for each adjacent panel are bolted together prior to fence assembly. Each adjacent post is mated to one another, and the user then makes sure to adjust the depth for step, sloping, or variable height configurations. Corner posts must be bolted at right angles to each other. T-Posts, where two segments of fencing join, require three posts, with the center post bolted at right angles to the outside posts. The user then fastens each pair of posts together (back to back, or back to side for a T-shape) via the included ½" bolts and nuts, preferably using four bolts that are equally spaced along the length of the posts. (150)

10. Then, the user verifies the proper hole depth by placing a post in each hole, and ensuring that the post extends the proper distance about ground level. (160) It may be necessary to add or remove additional dirt from the holes to obtain the proper desired height.

11. After proper hole depth is achieved, the user places posts in the holes, and aligns the open channel of each post in the direction of the fence, such that boards may be placed between each post within the post channels of each post. (170)

12. Then, each hole is filled with concrete to approximately two inches below grade level. Before the concrete sets, the user should plumb and level the post such that they are equally aligned. (180)

13. Then, the concrete is allowed to properly cure in accordance with the instructions of the concrete prior to proceeding. (190)

14. Next, the user begins installation of the bottom rail brackets and bottom rail by inserting a bottom rail bracket into the bottom of each post, as shown in FIG. 7. The bottom rail bracket should be aligned such that the top of the bracket is parallel to, and 2" above the ground. The user then tightens the bolt and nut using a wrench, and positions the bottom rail onto the bottom rail brackets. (200) It should be noted that, if the installation requires spacing between posts that is shorter than 96", the user will be required to saw a portion off of the top rail and bottom rail in order to fit between the posts.

Figure 11:
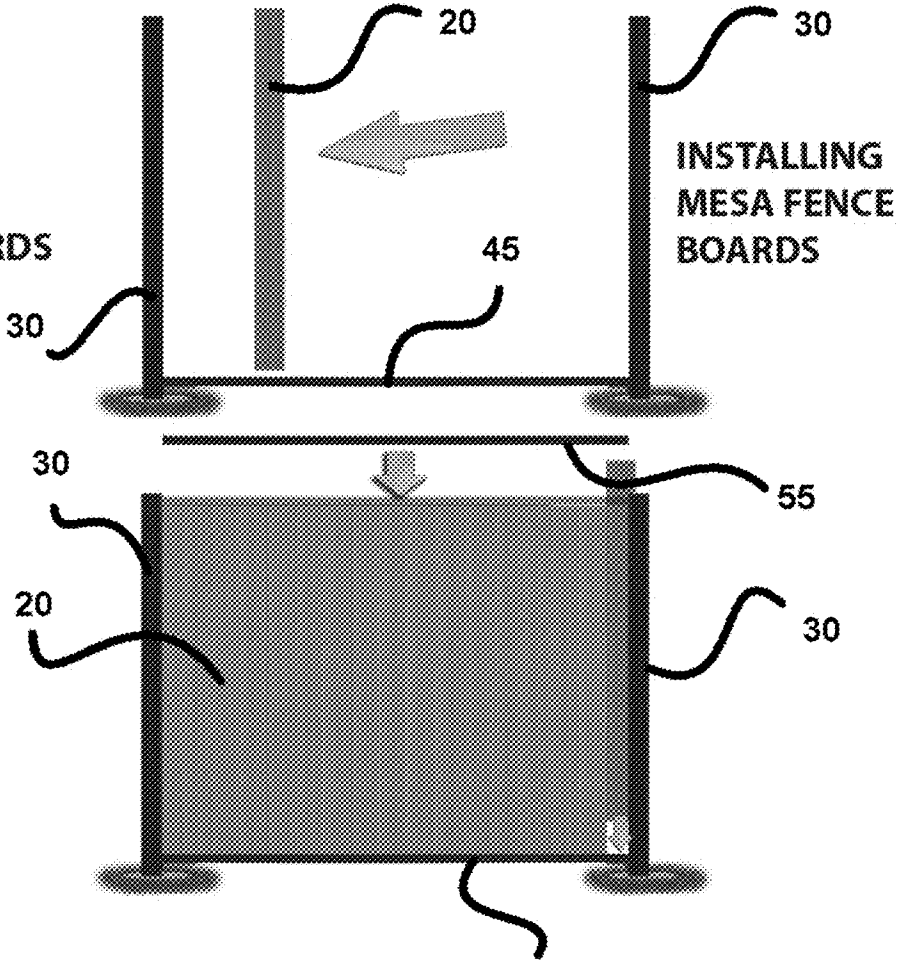
FIG. 11 depicts a view of the front of the Mesa embodiment of the present invention, detailing the installation of the vertical boards.
Figure 10:
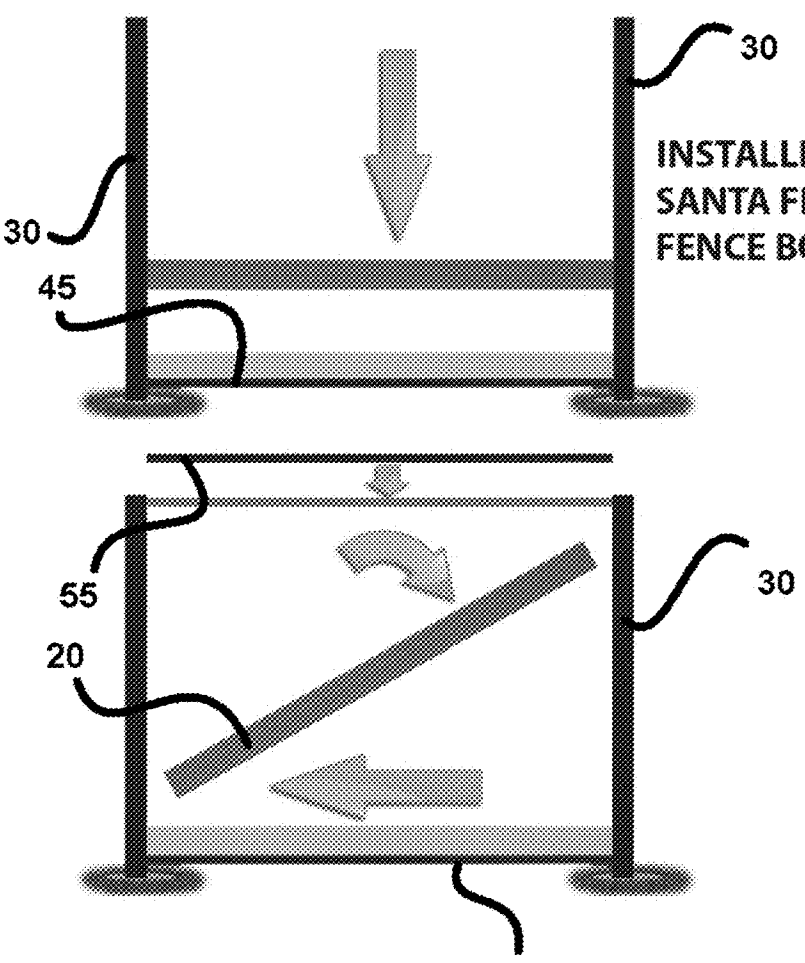
FIG. 10 displays a view of the front of the Santa Fe embodiment of the present invention, detailing the installation of the horizontal boards.
Figure 12:
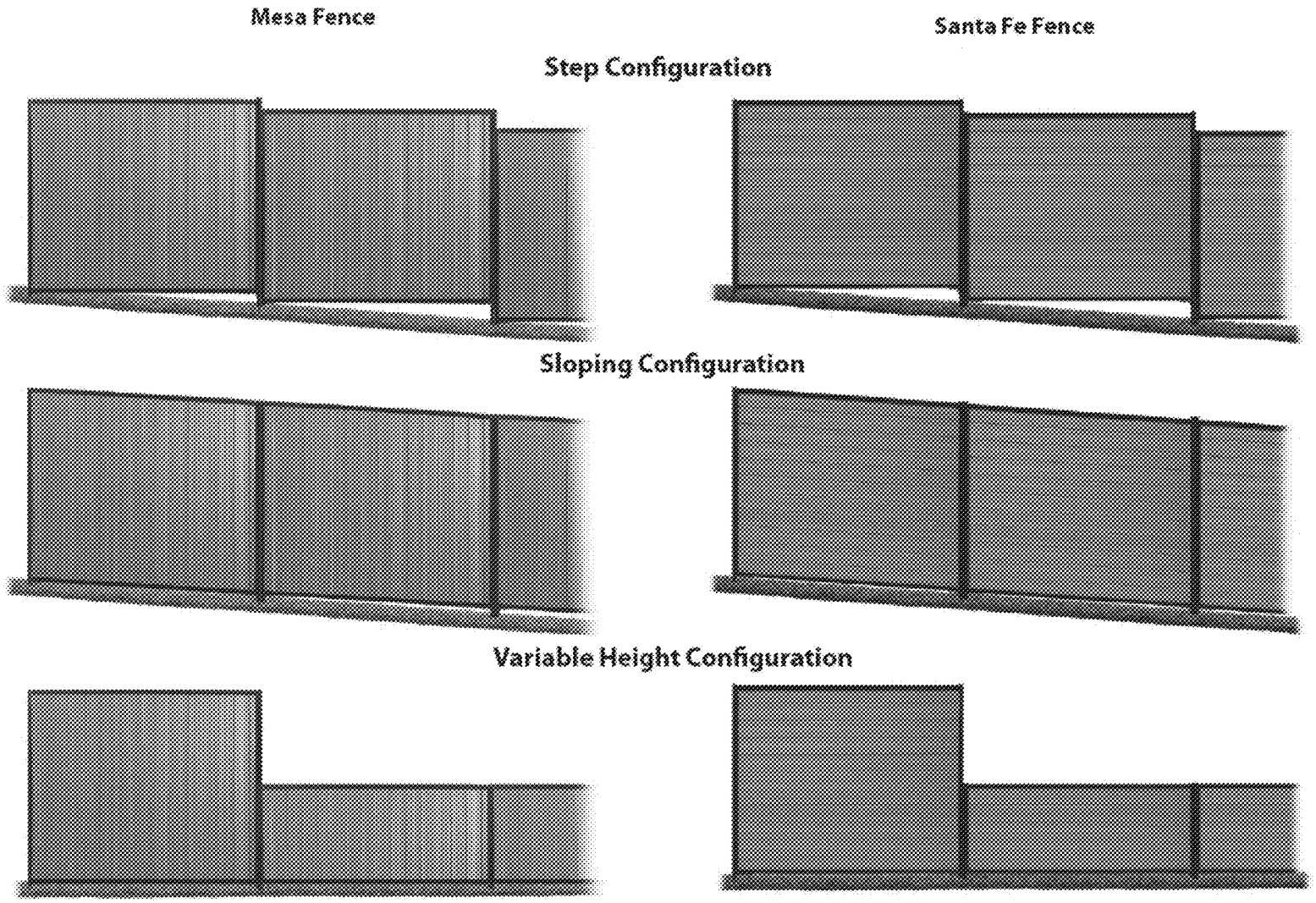
FIG. 12 shows each configuration of the present invention, including a step configuration, a sloping configuration, and a variable height configuration, shown in both the first embodiment and second embodiment of the present invention.

15. The user may then begin fence board installation. If the user has set the posts to be shorter than 90" apart, the user must first cut the horizontal fence boards to the correct length. The user measures the distance between the insides of the channel of the two posts, between which the fence boards will rest. The fence boards are cut to be ½" shorter than the distance measured in order to maintain ¼" gap between each end of the fence boards and the inside of each channel of each post. If the posts are 96" apart (eight feet), then no additional cutting is necessary. The fence boards are designed such that they are pre-cut to the maximum post spacing size. (210) 16. For Santa Fe fence installation, the fence boards are installed with the tongue of each fence board facing up, and the groove of each fence board facing down, such that they may interlock together. The user holds each fence board at an angle, and inserts one end into the channel of a post, then rotates the opposite end of the fence board down until it slides into the opposite channel of the second post, as shown in FIG. 10 and FIG. 11. (220).

17. For Mesa fence installation, mesa fence boards are installed with the groove of the first board disposed inside of one of the two posts, and the tongue facing outwards. (230)

18. After the first board is in place (of either the Mesa fence embodiment or the Santa Fe embodiment), the remaining fence boards may be placed into position such that the tongue of each board interlocks within the groove of the adjacent board. (240) The user is advised to not use a hammer to force the fence boards into position, as the composite fence boards could be damaged.

19. On Santa Fe fences, the last fence board may extend above the top of the posts, or alternately end too far below the top of the posts. If this occurs, the user simply adjusts the bottom rail brackets of the posts to achieve the correct alignment. (250)

20. On Mesa fences, all of the fence boards may extend above the top of the posts, or end too far below the top of the posts. If this occurs, the user adjusts the bottom rail brackets to achieve the correct alignment. (255)

21. After all boards are aligned and in position, the user installs the top rail between the posts. (260) No fasteners are needed, as the top rail will be secured by post and rail caps.

22. Finally, the user installs the post and rail cap, which is configured to fit over the top of the post, and extend over a portion of the top rail. (270) The user positions the post and rail cap such that it is centered over the post, and such that the cap extends onto the top rail equally on both sides of the post.

23. The user fastens the cap with self-tapping screws by positioning screws in the pre-drilled holes in the post and rail cap, and driving the screw into the top rail. (280)

It should be understood that multiple embodiments of the present invention are available simultaneously to provide choice to the user. In addition to the described Santa Fe Embodiment, depicting horizontal boards, and the Mesa embodiment, having vertical boards, a third 'basic' form of the present invention is also preferably available. Each embodiment of the present invention is preferably bundled as a kit, and each kit may be expanded with the purchase of additional modules if needed. The 'basic' embodiment kit includes two slotted vertical posts, 11 tongue and groove boards, two caps (for the top of the posts), and hardware. The Santa Fe embodiment kit preferably incudes two vertical slotted posts, one bottom rail, one top rail, 11 tongue and groove boards, two post caps, and hardware. Similarly, the Mesa embodiment kit includes two vertical slotted posts, a bottom rail, a top rail, 11 tongue and groove boards, two post caps, and hardware.

Additionally, it should be understood that alternate embodiments of the present invention may be designed to be taller than six feet. For example, some embodiments of the present invention may be capable of installations up to 12 feet in height through the use of higher caliber posts. Other heights can also be accomplished, especially via the Santa Fe embodiment.

Finally, it should be understood that all embodiments of the present invention are configured to functionally block both wind and noise, as well as to act as a visual barrier for privacy. The interlocking nature of the components of the present invention enables the modules to block wind effectively, without gaps, preventing individuals from peering through the module. The composite material of the present invention, namely of the boards (20) and posts (30), provide effective sound dampening properties.

Having illustrated the present invention, it should be understood that various adjustments and versions might be implemented without venturing away from the essence of the present invention. Further, it should be understood that the present invention is not solely limited to the invention as described in the embodiments above, but further comprises any and all embodiments within the scope of this application.

The foregoing descriptions of specific embodiments of the present invention have been presented for purposes of illustration and description. They are not intended to be exhaustive or to limit the present invention to the precise forms disclosed, and obviously many modifications and variations are possible in light of the above teaching. The exemplary embodiment was chosen and described in order to best explain the principles of the present invention and its practical application, to thereby enable others skilled in the art to best utilize the present invention and various embodiments with various modifications as are suited to the particular use contemplated.

I claim:

1. A modular fence system comprising:

a plurality of posts, each having a U-shaped cross-section comprising a left side, a right side and a bottom side defining a singular U-shaped channel, and having an interior and an exterior, said singular channel disposed within said interior of each post;

wherein said right side, said left side, and said bottom side of each said post are flat and equal in width;

wherein said right side abuts said bottom side at a perpendicular angle, said left side abuts said bottom side at a perpendicular angle, and said left side and said right side are parallel;

wherein said left and right sides are each curved inward towards said bottom side at an opening of the U-shaped channel;

wherein said posts are bolted together in two-post and three-post sets via bolts and each post set is disposed within a single hole in the ground;

wherein the two-post sets are disposed in a back-to-back orientation or side-to-back orientation;

wherein the back-to-back orientation has the bottom side of one said post flush against the bottom side of a second said post such that the channels of the posts face opposite directions to facilitate construction of inline fence modules;

wherein the side-to-back orientation has the left or right side of one said post flush against the bottom side of a second said post such that the channels of the posts are offset 90 degrees, facilitating a 90-degree corner in the modular fence system;

wherein the three-post sets are disposed in a T-post orientation wherein the bottom side of one said post is flush against the left side of a second said post and the bottom side of a third said post is flush against the right side of the second said post such that the channels of adjacent posts are offset 90 degrees, facilitating a T-shaped post for three adjoining fence modules;

wherein each pair of adjacent sets of posts defines a corresponding fence module therebetween, each module comprising:

a bottom rail extending between corresponding opposing posts of the adjacent sets of posts, the channels of the opposing posts being aligned with one another;

a plurality of boards disposed above said bottom rail, wherein said boards are hollow, and each of said boards comprising:

a groove disposed on a first longitudinally-extending edge thereof; and a tongue disposed on a second lonogitudinally-extending edge thereof opposite said groove;

wherein said boards interlock together tongue-to-groove to form a wind-resistant sound barrier, and the interlocked plurality of boards extended the length of the bottom rail and are received within the channels of the opposing posts; and a top rail disposed above said boards and extending between the opposing posts, comprising a bottom groove receiving the boards;

wherein said boards are constricted by said post channels and said top rail bottom groove such that they are immobile.

2. The system of claim 1, further comprising:

a pair of bottom rail brackets disposed beneath said bottom rail; and wherein said bottom rail bracket are mounted to said posts via screws.

3. The system of claim 1, wherein said boards are disposed vertically between said posts.

4. The system of claim 1, wherein said boards are disposed horizontally between said posts.

5. An assembly process for a wind-resistant, sound-barricading fence comprising:

selecting a location for the fence;

digging holes in the ground at the selected location;

providing a plurality of posts, each having a unitary U-shaped cross-section extending from a top of each post to a bottom of each post, comprising a right side, a left side, and a bottom side defining a U-shaped channel, and having an interior containing the channel and an exterior;

wherein the right side, the left side, and the bottom side of each post are flat and equal in width;

wherein the right side abuts the bottom side at a perpendicular angle, the left side abuts the bottom side at a perpendicular angle, and the left side and the right side are parallel;

wherein the left and right sides are each curved inward towards the bottom side at an opening of the U-shaped channel;

mounting the posts together in two-post and three-post sets with bolts;

wherein the two-post sets are disposed in a back-to-back orientation or side-to-back orientation;

wherein the back-to-back orientation has the bottom side of one said post flush against the bottom side of a second said post such that the channels of the posts face opposite directions to facilitate construction of inline fence modules;

wherein the side-to-back orientation has the left or right side of one said post flush against the bottom side of a second said post such that the channels of the posts are offset 90 degrees, facilitating a 90-degree corner in the fence;

wherein the three-post sets are disposed in a T-post orientation wherein the bottom side of one said post is flush against the left side of a second said post and the bottom side of a third said post is flush against the right side of the second said post such that the channels of adjacent posts are offset 90 degrees, facilitating a T-shaped post for three adjoining fence modules;

placing each set of posts in a respective one of the holes and surrounding the posts with concrete, each pair of adjacent sets of posts defining a corresponding fence module therebetween;

affixing rail brackets to bottoms of corresponding opposing posts of the adjacent sets of posts such that they mirror one another, the channels of the opposing posts being aligned with one another;

placing a bottom rail between the opposing posts, above the rail brackets;

providing a plurality of boards above the bottom rail, wherein each of the boards comprises a hollow air-tight cavity filled with air, and a groove and a tongue disposed on opposing longitudinally-extending edges thereof;

wherein said boards interlock together tongue-to-groove to form a wind-resistant sound barrier, and the interlocked plurality of boards extend the length of the bottom rail and are received within the channels of the opposing posts;

placing a top rail atop the boards, extending between the opposing posts, the top rail comprising a bottom groove receiving the boards; and placing a top cap atop each of the posts, locking the top rail in position above the boards without the use of a bracket;

wherein said boards are constricted by said post channels and said top rail bottom groove such that they are immobile.

6. The assembly process of claim 5, wherein the hollow air-tight cavity of the boards insulates against the passage of sound vibrations through the boards.

7. The assembly process of claim 5, further comprising:

orienting the boards horizontally; and disposing the boards within the U-shaped channels of the posts such that the tongue of each board interfaces with the groove of the subsequent board until the boards extend to a top of the posts.

8. The assembly process of claim 5, further comprising:

orienting the boards vertically; and disposing the boards between the posts such that the tongue of each board interfaces with the groove of the subsequent board until the boards extend to each post.

9. The assembly process of claim 5, wherein the selected location is sloped.

10. The assembly process of claim 9, wherein adjacent fence modules are stepped.

* * * * *